US007325438B2

(12) United States Patent
Heggemann et al.

(10) Patent No.: US 7,325,438 B2
(45) Date of Patent: Feb. 5, 2008

(54) CRIMPING TOOL FOR PLUG CONNECTORS HAVING CABLE SHIELD CLAMP MEANS

(75) Inventors: Christian Heggemann, Detmold (DE); Thomas Arndt, Detmold (DE); Günther Hanning, Detmold (DE); Thomas Köster, Schlangen (DE)

(73) Assignee: Weidmüller Interface GmbH & Co. KG, Detmold (DE)

( * ) Notice: Subject to any disclaimer, the term of this patent is extended or adjusted under 35 U.S.C. 154(b) by 117 days.

(21) Appl. No.: 11/260,696

(22) Filed: Oct. 27, 2005

(65) Prior Publication Data

US 2006/0107726 A1 May 25, 2006

(30) Foreign Application Priority Data

Nov. 22, 2004 (DE) ..... 20 2004 018 198 U

(51) Int. Cl.
*H01R 43/42* (2006.01)

(52) U.S. Cl. ..... 72/409.14; 29/751

(58) Field of Classification Search ..... 72/409.14, 72/409.13; 29/751, 750, 754, 749
See application file for complete search history.

(56) References Cited

U.S. PATENT DOCUMENTS 3,432,906 A * 3/1969 McNamara ..... 29/747
3,860,316 A * 1/1975 Hardesty ..... 439/344
4,429,451 A * 2/1984 Angelico ..... 29/566.4
4,667,398 A * 5/1987 Leiby ..... 29/749
5,402,561 A * 4/1995 Cerquone et al. ..... 29/751
6,230,387 B1 * 5/2001 Gritters et al. ..... 29/566.4
6,968,726 B2 * 11/2005 Wang ..... 72/409.14

FOREIGN PATENT DOCUMENTS

DE 296 01 264 U1 6/1996
DE 198 20 347 C2 5/2003

* cited by examiner

*Primary Examiner*—Daniel C Crane
(74) *Attorney, Agent, or Firm*—Lawrence E. Laubscher, Sr.; Lawrence E. Laubscher, Jr.

(57) ABSTRACT

A crimping tool is provided for crimping upon on a shielded data cable a plug connector having a body portion, and a cable shield clamping portion that is initially angularly arranged in an open loading position, characterized by the provision of a pair of operating handles that are pivotally connected for relative movement from an open position toward a partially closed intermediate position, thereby to displace the cable shield portion toward a crimping position in alignment with the plug connector body portion. A crimping arrangement is subsequently operable upon displacement of the handles from the intermediate position to the closed position to crimp not only the clamping portion concentrically about the outer circumferential surface of the shielded data cable, but also the region at the end of the plug connector body portion adjacent the clamping portion, thereby to crimp the female contacts of the plug connector onto the bare conductors of the cable.

14 Claims, 9 Drawing Sheets

CRIMPING TOOL FOR PLUG CONNECTORS HAVING CABLE SHIELD CLAMP MEANS

BACKGROUND OF THE INVENTION

1. Field of the Invention

A crimping tool is provided for crimping upon on a shielded data cable a plug connector having a body portion, and a cable shield clamping portion that is initially angularly arranged in an open loading position relative to said body portion, characterized by the provision of a pair of operating handles that are pivotally connected for relative movement from an open position toward a partially closed intermediate position, thereby to displace the cable shield portion toward a crimping position in alignment with the plug connector body portion. Upon displacement of the handles from the intermediate position to the closed position, crimping means are operable to crimp simultaneously both the clamping portion concentrically about the outer circumferential surface of the shielded data cable, as well as the region at the end of the plug connector body portion adjacent the clamping portion, thereby to crimp the contacts of the plug connector to the bare conductors of the cable.

2. Description of the Related Art

Pliers-type crimping tools are well known in the patented prior art for crimping plug connectors upon the bare conductors of a cable. Certain types of tools have been proposed for crimping onto a shielded data cable a plug connector having a body portion, and a clamping portion that is clamped about the outer periphery of the shielded cable. For ease of assembly of the data cable to the plug connector, the cable clamping means is normally angularly displaced to an offset position in which it will not obstruct and interfere with the assembly process.

In the German published patent application No. 296 01 264 U1, a tool is proposed for crimping the shield clamping means and the individual contacts of the plug connector in one step. Under normal operation, it is required that prior to the introduction of the components into the crimping tool, the shield clamp must be manually aligned with the connector body, thereby resulting in an additional assembly step.

In the crimping tool of the German patent No. DE 198 20 347 C2, two separate manual movements are required to actuate separate manual levers first to bend the shield clamp into the desired clamping position, and then to perform the actual crimping process. As in the aforementioned German published application No. DE 296 01 U1, two working steps are always required in order to connect a plug connector to the data cable.

The present invention was developed to avoid the above and other drawbacks of the known crimping tools, and to provide an improved tool in which the initial alignment of the clamping portion and the subsequent simultaneous crimping of the clamping portion and the body portion to the data cable is automatically achieved upon operation of the tool with a single gripping action.

BRIEF SUMMARY OF THE INVENTION

Accordingly, a primary object of the invention is to provide a crimping tool that includes straightening means operable upon the initial relative displacement of a pair of operating handles from the open position to an intermediate position to displace an angularly arranged plug connector cable clamping portion from an angularly arrange first position to a second position in alignment with the body portion of the plug connector, and crimping means operable upon displacement of the handles form the intermediate position to the closed position for simultaneously crimping the clamping portion to a closed condition concentrically about the data cable, together with the region at the end of the plug main body portion that is connected to the clamping portion.

According to a more specific object of the invention, the crimping tool includes a tool body having a plug seat for receiving the body portion of the plug, and the straightening means includes a first swage member that is movably connected with the tool body for movement relative to the plug seat. A cam and follower arrangement is operable upon initial relative pivotal movement of the handles from the open position to the intermediate position to operate a pivot lever arrangement, thereby to displace the first swage member from a retracted first position toward the plug seat, and to simultaneously displace the lug clamp portion from the angularly inclined position toward the aligned position relative to the main plug body. Spring means bias the first swage member back toward its normal first position, thereby returning the handles to their initial open condition.

According to a further object of the invention, the crimping means includes a first crimping element carried by the first swage element, second and third crimping elements carried by a second swage member connected for sliding movement relative to the tool body on the opposite side of the plug seat from the first swage member, and a stationary third swage member mounted on the tool body adjacent the first swage member. The second swage member is displaced relative to the tool body by means of an arrangement including a first pivot pin that is part of an operating linkage connected between the handles, and a second pivot pin that pivotally connects together first ends of the handles.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE INVENTION

Figure 1A:
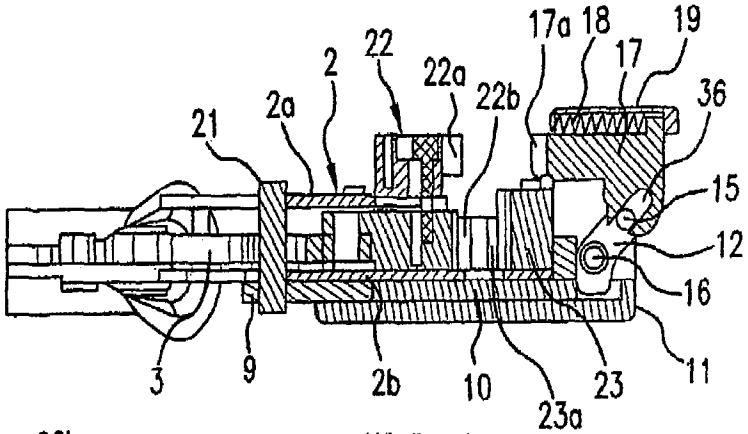
FIG. 1*a* is a longitudinal sectional view of the crimping tool of the present invention taken along line A-A of FIG. 1*b:*
Figure 1B:
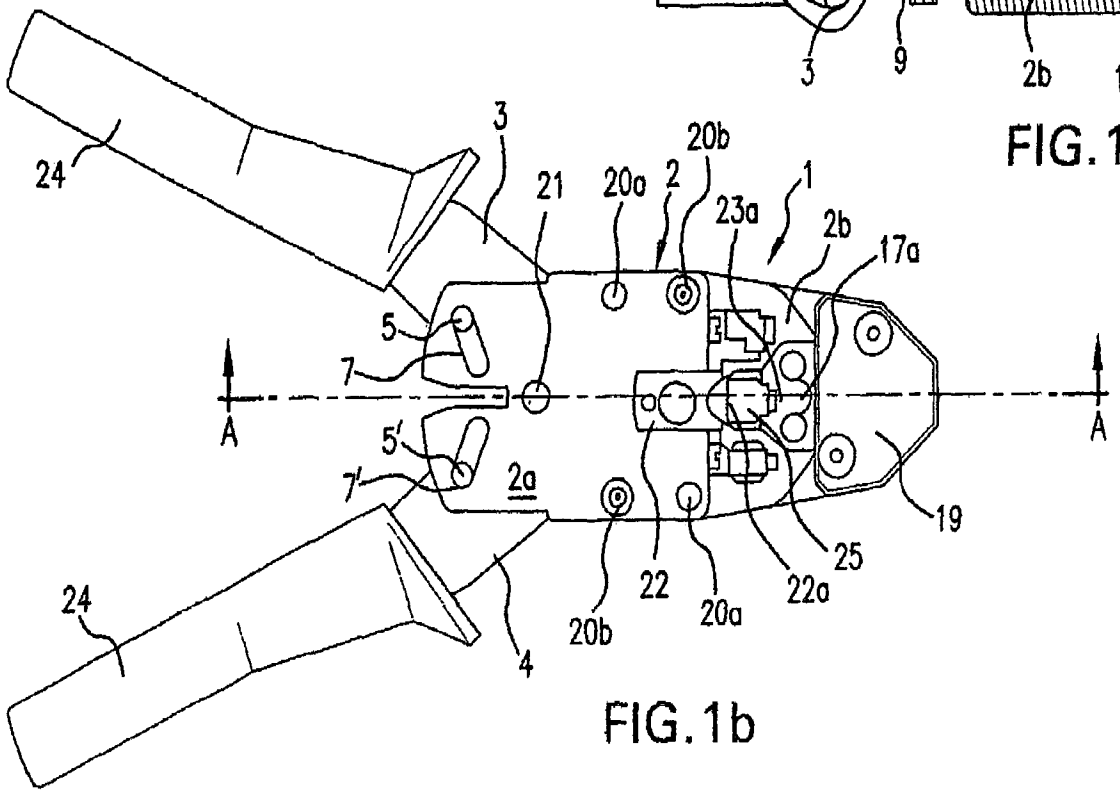
FIG. 1*b* is a right side elevation view of the apparatus of FIG. 1*a,* with certain parts removed, of the crimping tool when in its initial open condition.
Figure 1C:
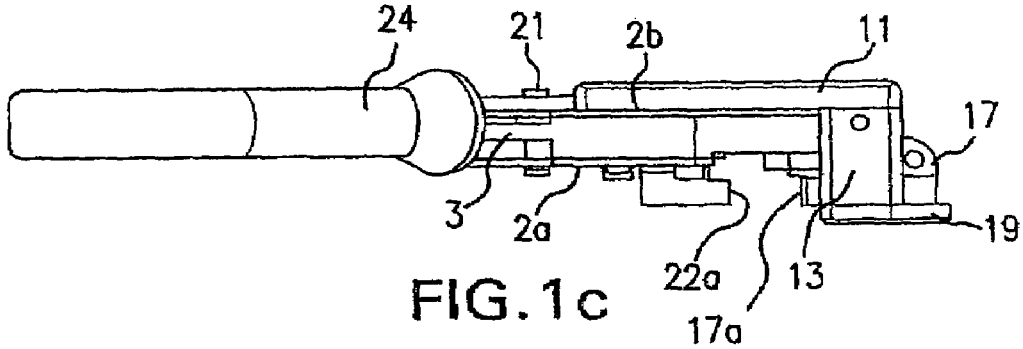
FIGS. 1*c* and 1*d* are top plan and right side elevation views of the apparatus of FIG. 1*a;*
Figure 1D:
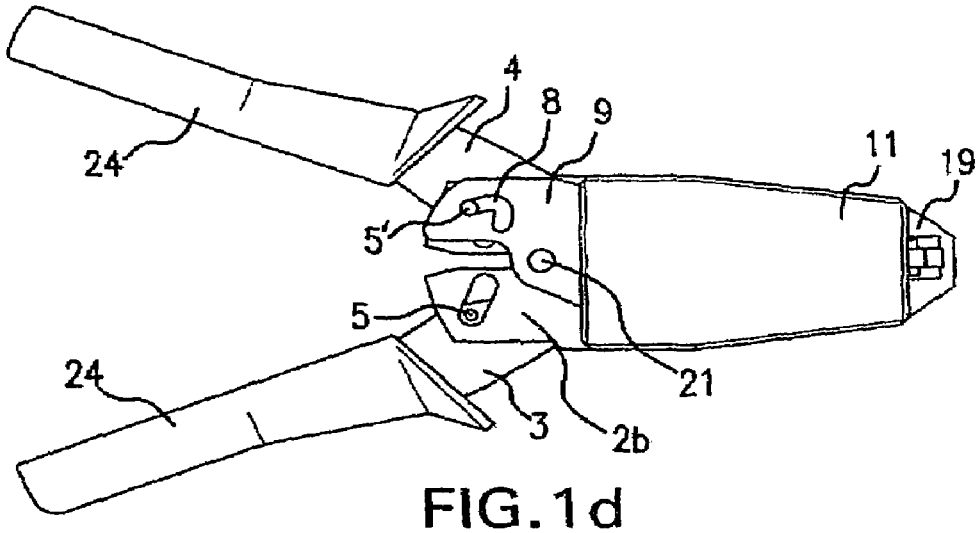
Figure 1E:
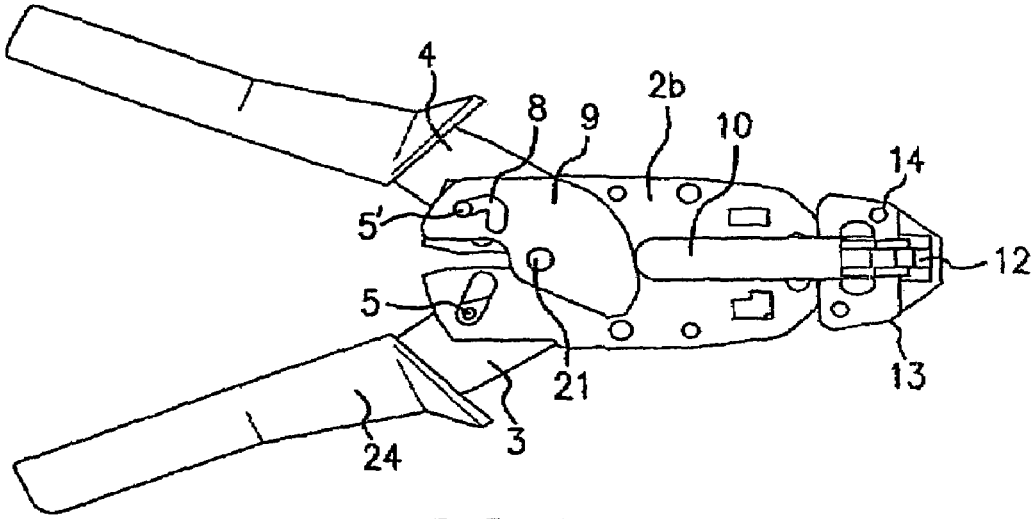
FIG. 1*e* is a left side elevation view corresponding with FIG. 1*d,* with the cover plate removed.
Figure 1F:
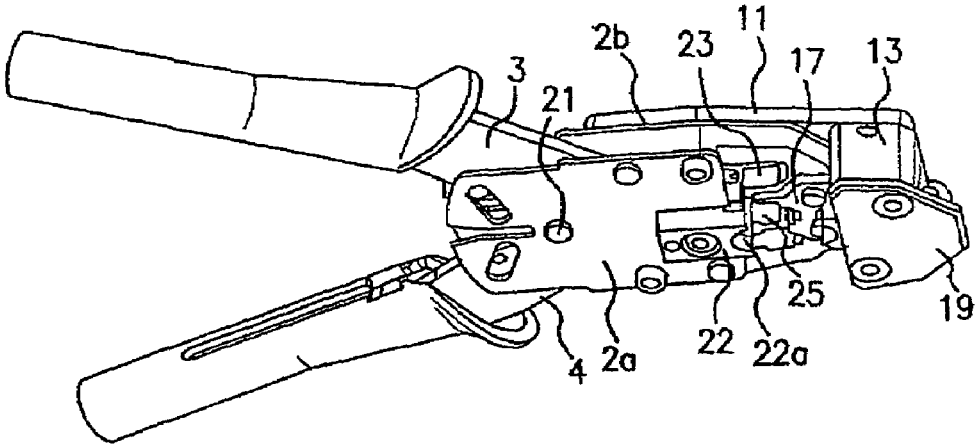
FIGS. 1*f* and 1*g* are right and left perspective views, respectively, of the apparatus of FIG. 1*a;*
Figure 1G:
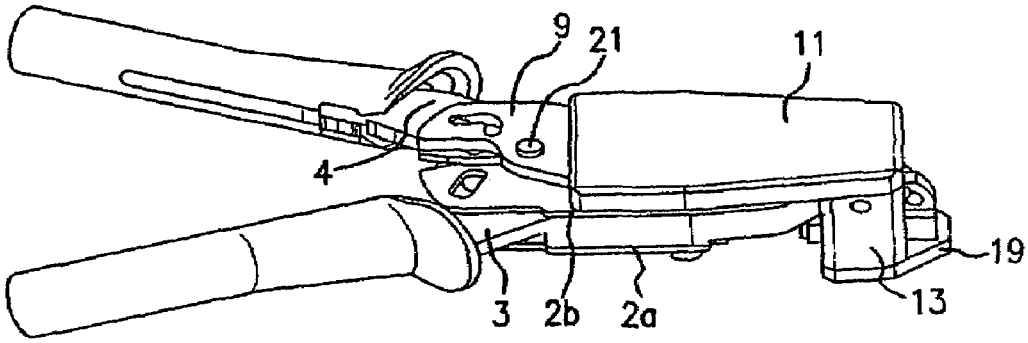
Figure 1H:
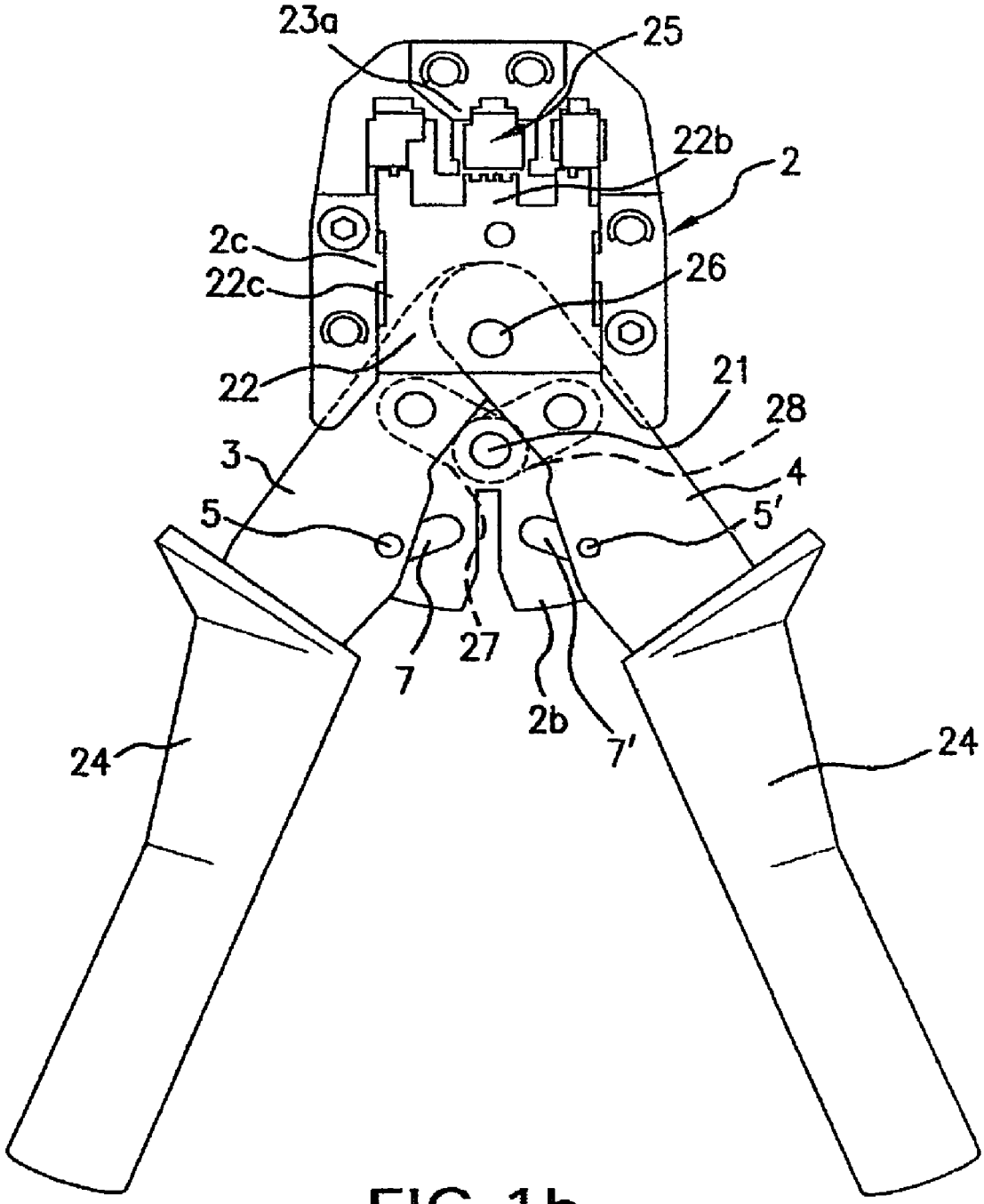
FIG. 1*h* is a right side elevation view of the apparatus of FIG. 1*b* with one tool body side plate removed.

Referring first more particularly to FIGS. 1*a* and 1*b*, the crimping tool 1 of the present invention includes a tool body 2 having by a pair of parallel spaced side plates 2*a* and 2*b* that define a space that receives the adjacent first end portions of a pair pivotally displaceable handles 3 and 4. The ends of these handle first end portions are pivotally connected together by the pivot pin 26, as shown in FIG. 1*h*. The tool body side plates 2*a* and 2*b* are fastened together on opposite sides of the handle first ends by rivets 20*a* and Segar ring fasteners 20*b*. The handles 3 and 4 are provided at their other ends with hand grip portions 24.

Rigidly connected with the tool body 2 is a cover plate 11 that is parallel with the tool side plate 2*b*. As will be described in greater detail below, a plug seat opening 25 is defined on the tool body for receiving the plug connector B of FIG. 4*a* that is to be crimped onto the outer circumference of a data cable D by the crimping tool 1. A first pair of crimping elements 17*a* and 23*a* are arranged on one side of the plug seat opening, and a second pair of crimping elements 22*a* and 22*b* are arranged on the opposite side of the plug seat opening.

According to a characterizing feature of the present invention, the crimping element 17*a* is carried by a first swage member 17 that is slidably connected with a stationary support plate 19 for movement from a normally retracted first position (FIG. 1*a*) spaced from the plug seat toward an intermediate position (FIG. 2*a*) that is closer to the plug seat, and from the intermediate position toward a final second crimping position (FIG. 3*a*) adjacent the plug seat. As best shown in FIG. 1*e*, the support plate 19 is supported in spaced fixed relation to the tool body above the cover member 11 by a pair of laterally spaced support columns 13 and 14. Compression spring 18 biases the swage member 17 to the right in FIG. 1*a* against the abutment surface provided on the support plate 19.

The second swage member 22 is connected for sliding movement from a first retracted position (FIG. 1*b*) relative to the plug seat opening 25 toward an intermediate position (FIG. 2*b*) closer to the plug seat opening, and then to a final second position (FIG. 3*b*) adjacent the plug seat opening. A stationary third swage member 23 is fixed to the tool body and abuts a fixed abutment thereon, as best shown in FIG. 1*a*.

Figure 4A:
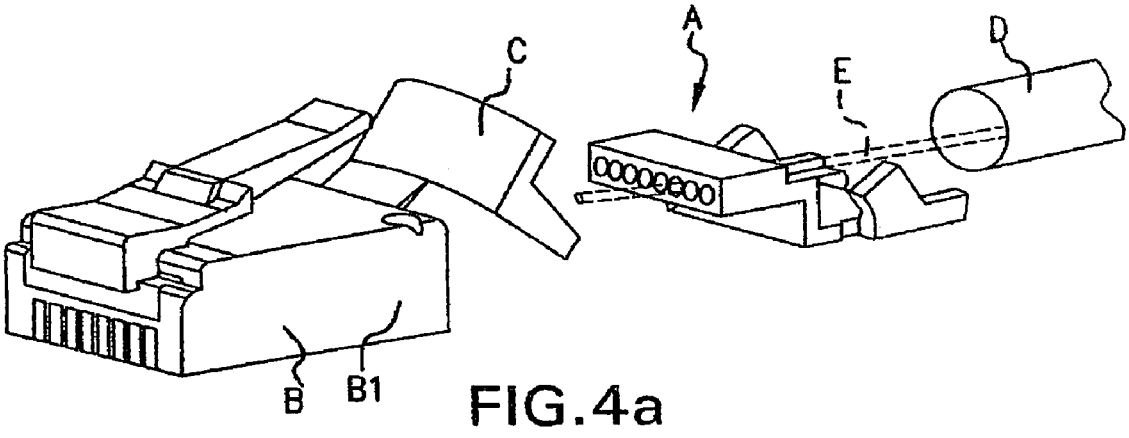
FIG. 4*a* is an exploded perspective view illustrating the use of a coding module assembly in guiding the conductors of a shielded data cable for connection with the plug module with the cable clamping portion in its initial angularly arranged position.
Figure 4B:
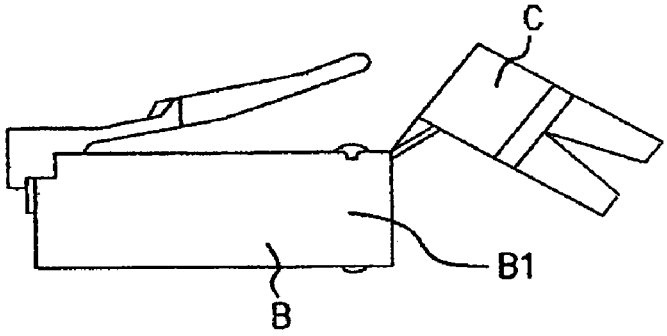
FIG. 4*b* is a side elevation view of the plug connector with the clamping portion in the angularly arranged loading position.
Figure 4C:
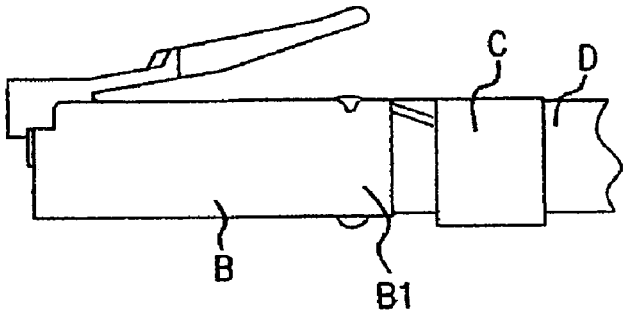
FIG. 4*c* is a side elevation view of the assembled, clamped plug connector arrangement.

Referring now to FIGS. 4*a*-4*c*, the crimping tool of the present invention is specifically designed to crimp upon a shielded data cable D a plug connector B to which is flexibly connected a cable clamping portion C. The cable clamping portion C is initially in an open loading position that is angularly arranged at an acute angle relative to the longitudinal axis of the plug connector B. A coding module A serves to guide the bare conductors of the cable into the desired female contacts of the connector, whereupon the clamping portion C is progressively bent down from the inclined position of FIG. 4*b* to the second position of FIG. 4*c*, and the legs of the clamping portion are crimped into rigid engagement with the outer circumferential surface of the data cable. Simultaneously with the crimping of the leg portions of the clamping portion, the adjacent end portion $B_1$ of the plug connector is crimped to rigidly fasten the conductors E to the corresponding female contacts (not shown) of the plug connector.

Figure 2A:
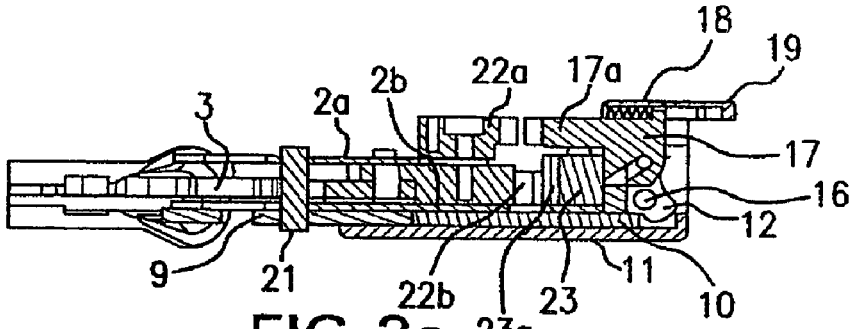
FIGS. 2*a*-2*g* correspond to FIGS. 1*a*-1*g,* respectively, with the handles of the crimping tool in a partially closed intermediate position.
Figure 2B:
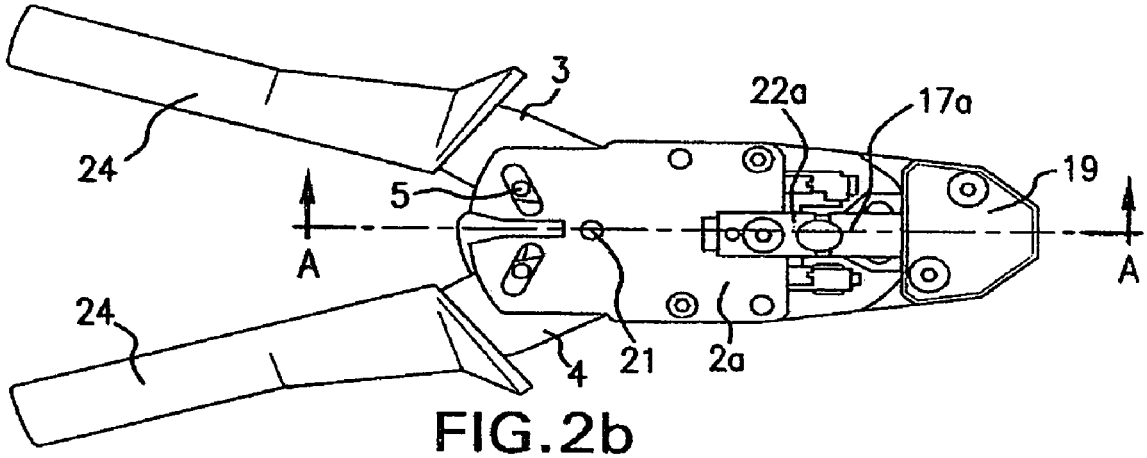
Figure 2C:
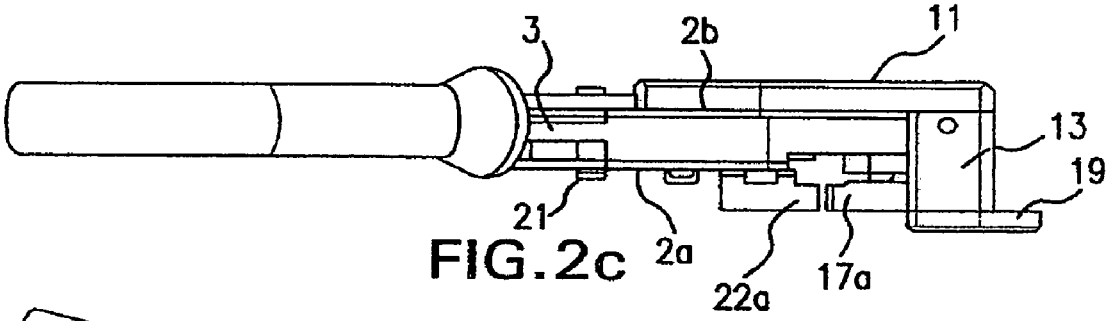
Figure 2D:
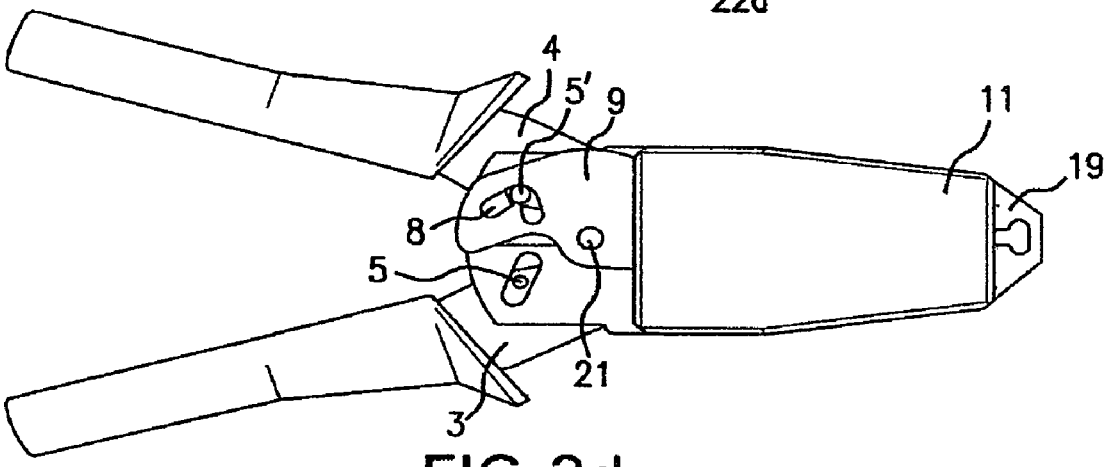
Figure 2E:
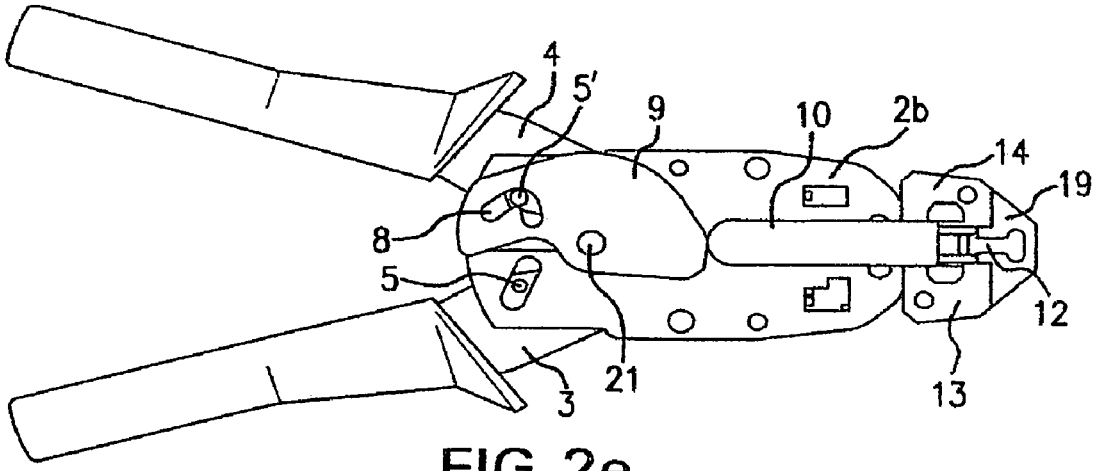
Figure 2F:
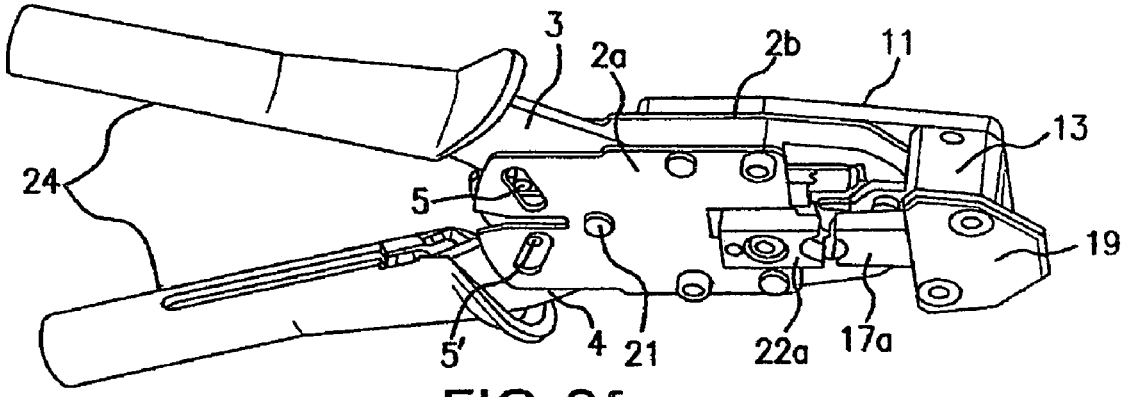
Figure 2G:
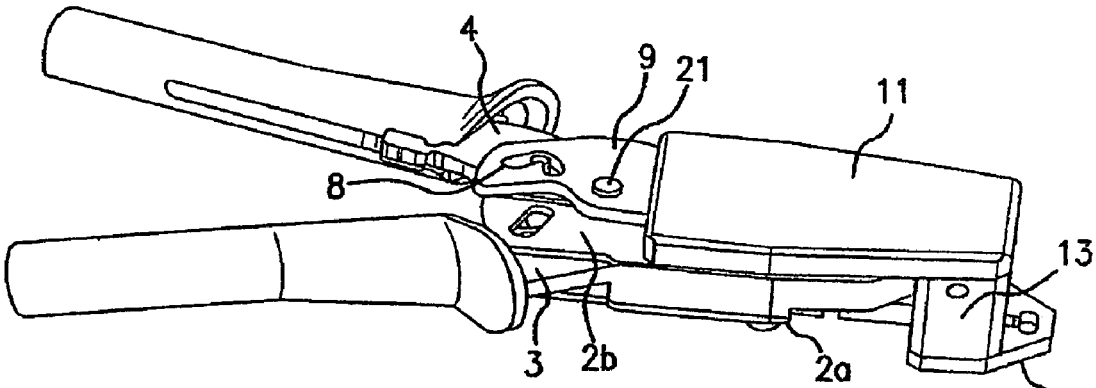
Figure 3A:
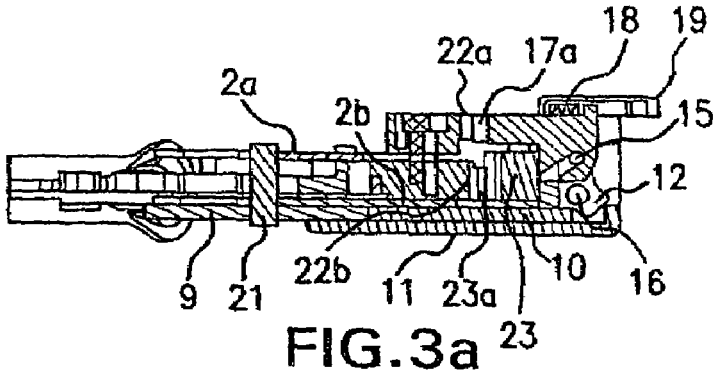
FIGS. 3*a*-3*g* correspond to FIGS. 1*a*-1*g,* respectively, with the handles of the crimping tool in the fully closed position.
Figure 3B:
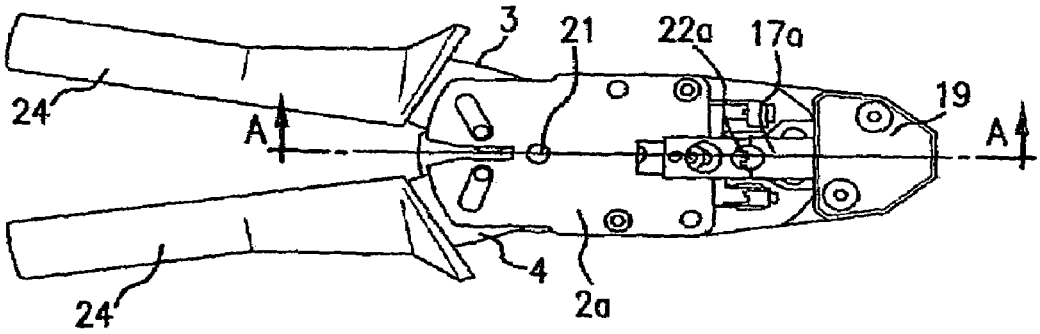
Figure 3C:
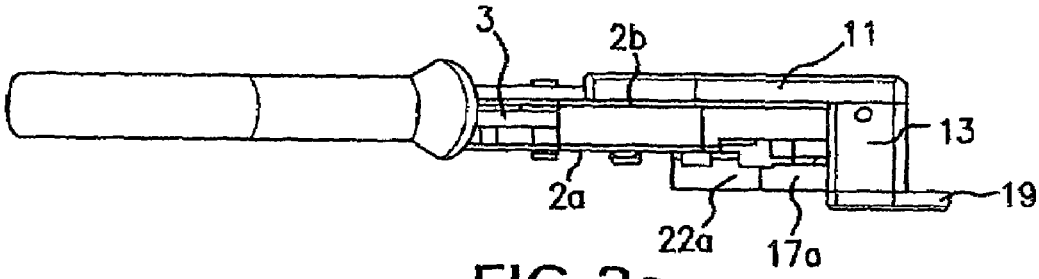
Figure 3D:
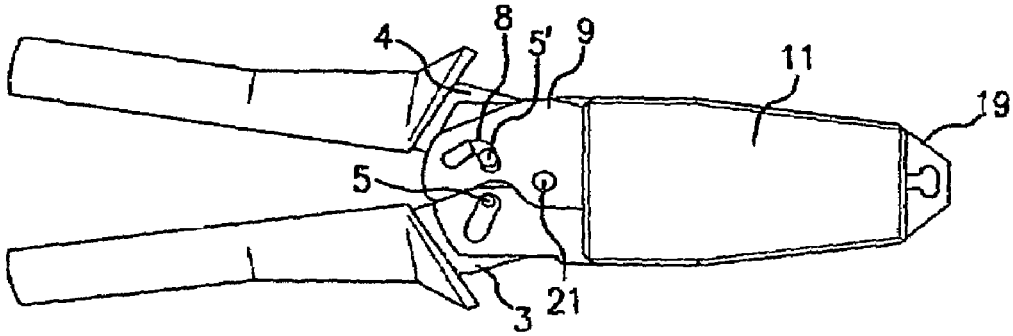
Figure 3E:
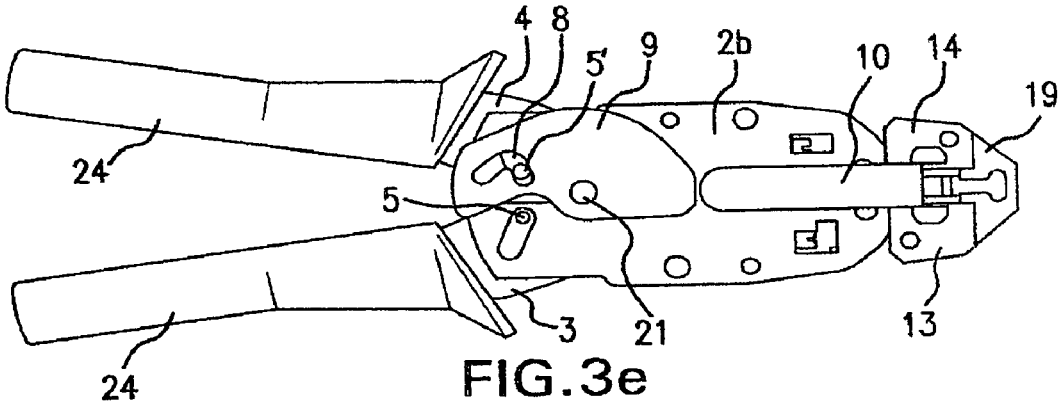
Figure 3F:
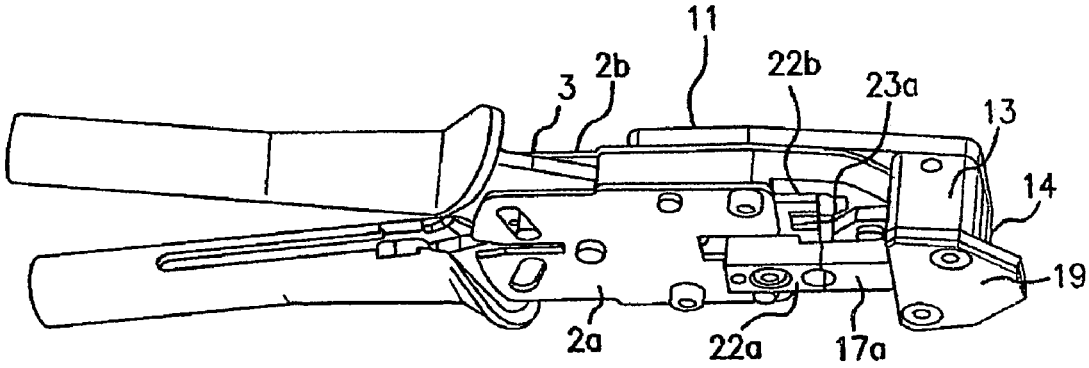
Figure 3G:
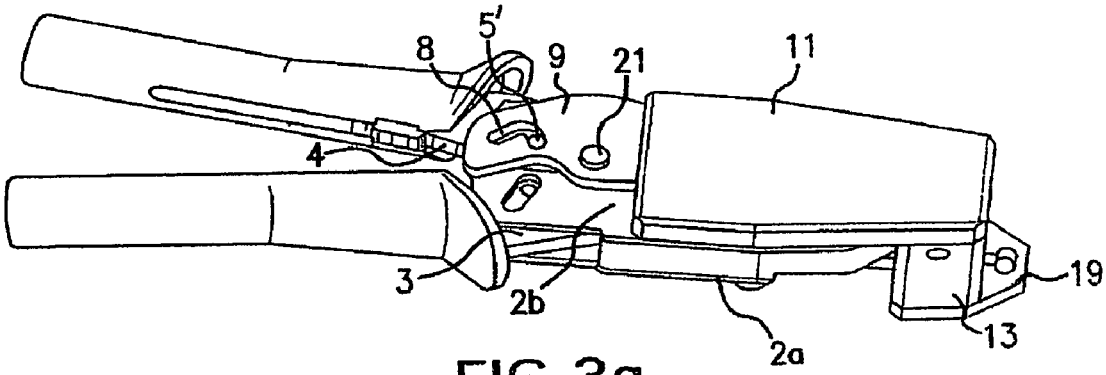

The crimping tool of the present invention was so designed as to produce this sequential connection of the data cable D to the plug connector B by continuous pivotal movement of the tool handles from their fully open condition of FIG. 1*b* to the fully closed position of FIG. 3*b*. To this end, the pivotally connected handles 3 and 4 are connected with the tool body 2 by a linkage means (FIG. 1*h*) including a pair of links 27 and 28 the adjacent ends of which are pivotally connected with a first pivot pin 21 that extends between corresponding openings contained in the tool body side plates 2*a* and 2*b*. The remote ends of these links are pivotally connected with the legs 3 and 4, respectively. Furthermore, the handles 3 and 4 carry control pins 5 and 5' that extend into guide slots 7 and 7' contained in the side plates, respectively. control pin 5' also extends into an L-shaped slot 8 contained in a control cam 9 that is connected by pivot pin 21 for pivotal movement relative to the tool body from a first position shown in FIG. 1*e* toward the intermediate position of FIG. 2*e*, and then from the intermediate position toward the final position shown in FIG. 3*e*. A cam follower member 10 is connected for longitudinal sliding movement relative to the axis of the tool body 2 and includes a first end in engagement with the cam surface of the cam 9, and a second end that engages an L-shaped pivot operating lever 12, as shown in FIGS. 1*a* and 1*e*. The pivot operating lever 12 is mounted for rotation about a pivot shaft 16 that is supported at its ends between the support columns 13 and 14. The pivot operating lever is connected with the first swage member 17 by pin and slot means including operating pins 15 that extend laterally from the pivot lever into corresponding operating slots 36 contained in the first swage member. Therefore, as the cam member 9 is pivoted upon operation of the handles from the initial first position of FIG. 1*e* toward the intermediate position of FIG. 2*e*, the pivot lever is pivoted by the follower 10 toward the intermediate position of FIG. 2*a*, and the first swage member is displaced to the left against the biasing force of spring 18 toward the intermediate position of FIG. 2*a*. As shown in FIG. 2*d*, at this time, the operating pin 5 is adjacent the apex or intersection of the two leg portions of the L-shaped slot 8. When the cam member 9 is pivoted further toward the final position of FIG. 3*e*, the pivot lever 12 is pivoted to displace the first swage member 17 toward the final crimping position of FIG. 3*a* The control pin 5' is now in the second leg portion of the L-shaped slot 8, thereby to lock the first swage member 17 in place.

Referring again to FIG. 1*h*, the second swage element 22 is guided for longitudinal displacement relative to the tool body 2 by projection and slot means including lateral projections 2*c* that extend from the fool body into corresponding slots 22*c* contained in the side edges of the second swage member 22. When the handles are displaced together from the open position of FIG. 1*b* toward the partially closed position of FIG. 2*b*, the pivot pin 26 and the second swage member 22 are displaced toward the plug seat 25 and the stationary third swage member 23. Upon further movement of the handles toward the fully closed crimping position of FIG. 3*b*, the second swage member 22 is brought toward the plug seat 25 to effect crimping cooperation between the second and third crimping elements 22*a* and 22*b* on the second swage member, and the first and fourth crimping elements 17*a* and 23*a*, respectively.

OPERATION

In operation, assuming that the plug connector of FIG. 4*a* is inserted left hand end down into the plug seat opening, with the angularly arranged cable clamp portion C facing the first swage member 17. Assume also that the data cable D and the coding module A are positioned to cause the bare conductors E of the cable to enter the corresponding female contacts (not shown) contained in the plug connector. The handgrip portions 24 of the handles 3 and 4 are squeezed together to effect rotation of cam 9 about pivot pin 21, wherein cam 9 is rotated from its initial position of FIG. 1*e* toward the intermediate position of FIG. 2*e*. Cam follower 10 is shifted to the right to pivot lever 12 in the counterclockwise direction in FIG. 1*a*, whereby the first swage member 17 is shifted to the left to the partially closed intermediate position of FIG. 2*a*. During this initial sliding movement of the first swage member, the first swage element engages the cable clamping portion C of the plug connector, and bends the same toward a position in alignment with the longitudinal axis of the plug connector. It should be noted that the arrangement is such that during this movement of the first swage member at a relatively high speed toward the plug seat 25, the second swage member 22 is displaced at a slower speed toward the plug seat 25 by the operation of the linkage means 21, 26, 27 and 28. The operating pin 5 on the handle 3 is now at the apex of the L-shaped slot 8, as shown in FIG. 2*e*.

Upon further squeezing of the handle portions 24 together toward the fully closed position of FIG. 3*b*, the first and second crimping elements 17*a* and 22*a* cooperate to crimp the cable clamping legs of the clamping portion C concentrically about the outer circumferential surface of the shielded data cable D. Similarly, the crimping elements 22*b* and 23*a* cooperate to crimp the end portion $B_1$ of the plug connector, thereby to crimp the female contacts upon the bare conductors E. Upon release of the handles, they are returned to their initial open condition by compression spring 18.

As indicated above, the operating mechanism is so designed that the first swage member moves toward the plug set opening 25 faster than the second swage member 22, thereby to effect the desired preliminary straightening of the clamp portion C of the plug connector B. Referring to FIG. 2*a*, it will be seen that when the first swage member is shifted to the left by the pivot lever 12, the first swage member comes into abutting engagement with the third swage member 23. During the final movement of the cam member 9 from the position of FIG. 2*e* to the final position of FIG. 3*e*, the control pin 5 enters the second leg of the slot 8, thereby to lock the first swage member against the third swage member, as shown in FIG. 3*a*.

While in accordance with the provisions of the Patent Statutes the preferred forms and embodiments of the invention have been illustrated and described, it will be apparent to those skilled in the art that various changes may be made without deviating from the inventive concepts set forth above.

What is claimed is:

1. A crimping tool for crimping onto a shielded data cable (D) a plug connector including a main body portion (B) having a first end portion ($B_1$), and a cable shield clamp portion (C) connected with said main body first end portion, said cable shield clamp portion initially being in an open condition and arranged in a first position at an acute angle relative to the longitudinal axis of said main body portion, comprising:

(a) means defining a tool body (2) having a plug seat opening (25) for receiving said plug connector body portion;

(b) a pair of handles (3,4) connected with said tool body for pivotal movement (26) between open, intermediate and closed positions, respectively;

(c) straightening means (9, 10, 12, 17) operable when said handles are displaced from said open position toward said intermediate position for pivoting said cable shield clamp portion from said first position toward a second position in alignment with the longitudinal axis of said plug main body portion; and (d) crimping means (17*a*, 22*a*, 22*b*, 23*a*) operable when said handles are displaced from said intermediate position to said closed position for simultaneously;

(1) crimping said cable shield clamp portion concentrically about the outer surface of the cable by means movable toward said straightening means, and (2) for crimping said first end portion ($B_1$) of said main body portion adjacent said cable shield clamp portion.

2. A crimping tool as defined in claim 1, wherein said straightening means comprises:

(1) a first swage member (17) connected with said tool body for displacement between a first position remote from said plug seat opening and a second position adjacent said plug seat opening; and (2) first operating means (9, 10,12) operable by said handles during the movement thereof from said open position toward said intermediate position for pivoting said first swage member from said first position toward said second position, thereby to cause said first swage member to displace said plug shield clamp portion to the aligned position relative to said plug body portion.

3. A crimping tool as defined in claim 2, wherein said first operating means comprises:

(a) a cam member (9) pivotally connected with said tool body by a first pivot pin (21);

(b) cam operating means (5, 8) responsive to the pivotal movement of said handles for pivoting said cam member about said first pivot pin;

(c) a follower member (10) mounted on said tool body for linear axial displacement by said cam member between first and second positions remote from and adjacent to said plug seat, respectively;

(d) pivot lever means (12) pivotally connected with said tool body for movement by said follower member between first and second positions relative to said tool body; and (e) connecting means (15, 36) connecting said pivot lever means with said first swage member to effect movement of said first swage member from said first position to said second position upon movement of said follower member from said first position to said second position.

4. A crimping tool as defmed in claim 3, wherein said tool body comprises:

(1) a pair of parallel spaced side plates (2*a*, 2*b*); and (2) means (20*a*, 20*b*) connecting together said side plates; and further wherein said handles include:

(1) first ends that extend between said spaced side plates and that are pivotally connected by a second pivot pin (26), and (2) second ends arranged for engagement by the hand of a user of the crimping tool;

(3) and further including guide pin and slot means (5, 5', 7) connecting said handle first portions for guided movement relative to said tool body.

5. A crimping tool as defined in claim 4, and further including:

(e) a cover plate (11) connected with said tool body in parallel spaced relation relative to one (2*b*) of said side plates, said cam and follower members being arranged in the space between said cover plate and said one side plate, said cam member containing an operating slot (8) that receives one of said guide pins (5).

6. A crimping tool as defined in claim 5, wherein said crimping means comprises (1) a first swage element (17*a*) carried by said first swage member adjacent said plug seat;

(2) a second swage member (22) slidably connected with said tool body on the opposite side of said plug seat opening from said first swaging member, said second swage member being slidably displaceable between first and second positions remote from and adjacent said plug seat opening, respectively; said second swage member carrying adjacent said plug seat opening a second swage element (22*a*) opposite said first swage element, and a third swage element (22*b*);

(3) a stationary third swage member (23) connected with said tool body on the opposite side of said plug seat opening from said second swage member, said third swage member carrying a fourth swage element (23*a*) opposite said third swage element; and (4) second operating means operable by said handle means during the operation thereof from said intermediate position to said closed position for operating said second swage member from said retracted position to said extended crimping position.

7. A crimping tool as defined in claim 6, wherein said second operating means comprises:

(a) means connecting said second pivot pin (26) with said second swage member; and (b) linkage means including a pair of links (27, 28) pivotally connected at their remote ends with said handle first ends at locations between said second pivot pin and said second handle ends, respectively; the adjacent ends of said links being pivotally connected by said first pivot pin (21).

8. A crimping tool as defined in claim 6, and further including:

(f) support means (13, 14, 19) supporting said first swage member (17) for sliding displacement above said stationary third swage member (23).

9. A crimping tool as defined in claim 8, wherein said supporting means comprises:

(1) a pair of parallel spaced support columns (13, 14) connected at one end with and extending normal to said cover plate on opposite sides of said pivot lever;

(2) a mounting plate (19) connected between the free ends of said columns, said first swage member being connected with said mounting plate for sliding movement between said columns.

10. A crimping tool as defined in claim 9, and further including:

(3) return spring means (18) biasing said first swage member toward its first position, thereby to reset said crimping tool to its initial open condition.

11. A crimping tool as defined in claim 9, wherein said pivot lever means includes a pivot shaft (16) connected between said columns.

12. A crimping tool as defined in claim 8, wherein said first swage member (17), when in said second position, has an end surface in abutting engagement with said third swage member (23).

13. A crimping tool as defined in claim 7, wherein said cam operating means comprises control pin and slot means (5', 8) operable to cause said first swage member to be shifter from it first position toward its second position faster that the shifting of said second swage member from its first position toward its second position.

14. A crimping tool as defined in claim 13, wherein said control pin and slot means includes:

(1) a control pin (5') mounted on one of said handles; and (2) a generally L-shaped control slot (8) contained in said cam member, said control slot having a first leg that receives said control pin during the initial travel of said handles from said open position to said intermediate position, and a second leg that receives said control pin during the final travel of said handles from said intermediate position to said closed position.

* * * * *